US006073816A

United States Patent [19]

Granberg

[11] Patent Number: 6,073,816

[45] Date of Patent: Jun. 13, 2000

[54] DRIP-CATCHER AND A METHOD THEREFOR

[76] Inventor: Preben Granberg, Postbox 79 Hinbjerg 38, DK 2690 Karlslunde, Denmark

[21] Appl. No.: 08/836,020

[22] PCT Filed: Jan. 21, 1994

[86] PCT No.: PCT/DK96/00329

§ 371 Date: Mar. 30, 1998

§ 102(e) Date: Mar. 30, 1998

[87] PCT Pub. No.: WO95/19917

PCT Pub. Date: Jul. 27, 1995

[30] Foreign Application Priority Data

Jul. 26, 1995 [DK] Denmark ..... 0861/95

[51] Int. Cl.[7] ..... B65D 5/74

[52] U.S. Cl. ..... 222/566; 222/571

[58] Field of Search ..... 222/571, 566, 222/569, 574, 527; 141/332, 390

[56] References Cited

U.S. PATENT DOCUMENTS

| | | | |
|---|---|---|---|
| 2,054,265 | 9/1936 | Muguerditchian | 141/332 |
| 3,181,742 | 5/1965 | Kebert | 222/527 |
| 5,121,779 | 6/1992 | Green | 141/390 |
| 5,651,481 | 7/1997 | Jensen | 222/566 |

FOREIGN PATENT DOCUMENTS

| | | | |
|---|---|---|---|
| 92/05080 | 4/1992 | WIPO | 222/571 |

*Primary Examiner*—Philippe Derakshani
*Attorney, Agent, or Firm*—Rolf Fasth; Fasth Law Offices

[57] ABSTRACT

A drip-catcher that is easily insertable into the opening of a bottle or similar container. The drip-catcher is self-adjusting and adapted to be inserted into the opening of the bottle with one hand. The drip-catcher is heart-shaped and includes a central groove defined at an upper end of the heart-shaped drip-catcher.

2 Claims, 3 Drawing Sheets

DRIP-CATCHER AND A METHOD THEREFOR

TECHNICAL FIELD

The present invention relates to a heart-shaped drip-catcher. More particularly, the drip-catcher may be pushed into the opening of a bottle to prevent undesirable dripping when liquid is poured out of the bottle.

A similar drip-catcher in known from WO 95/19917.

Drip-catchers of this kind are intended for being placed in the opening of bottles, containers, test tubes and other receptacles containing a liquid (hereafter called: container) for improving the flow of liquid, so as to form a well defined jet. Otherwise, the jet is usually uneven and sometimes splashing, e.g. from a bottle.

The known drip-catcher:

1. is to be folded and sqeezed in the belonging wings, by use of both hands, and to be kept sqeezed during insertion in the container, the folding of the lower wings being adjusted to the opening of the container, also by the use of both hands.
2. by removal from the container, must be guarded against the unfolding force, which usually flings remains of liquid on the inside of the piece over 180°.
3. cuts the flow of liquid several times, caused by a wave effect. See the decription later in the application.

It is the purpose of the invention to remedy these defects. This is done by shaping the drip-catcher in question.

DETAILED DESCRIPTION

Figure 1:
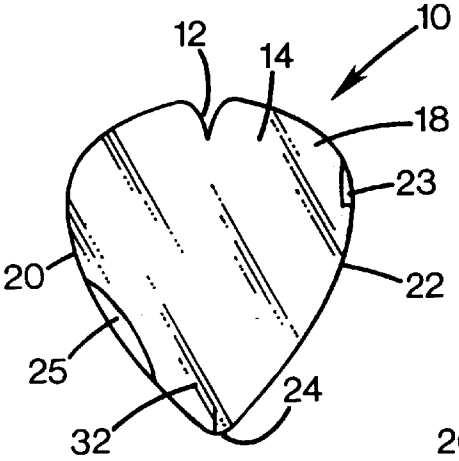
FIG. 1 is a side view of the drip catcher of the present invention.
Figure 2:
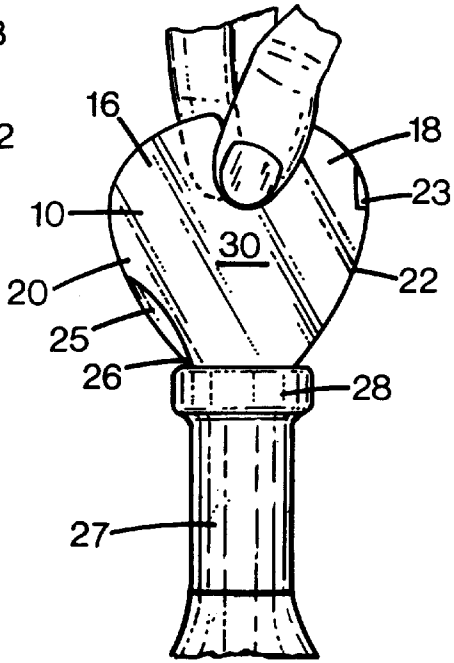
FIG. 2 is a front view of the drip catcher partially inserted into a container.
Figure 3:
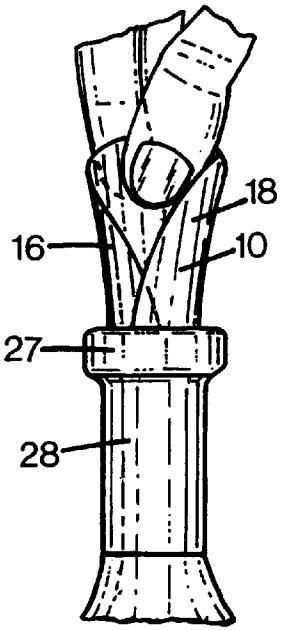
FIG. 3 is a perspective view of the drip catcher in a partially folded position inside the container.

With reference to FIGS. 1–9, the drip catcher 10 is heart-shaped and has an upper groove 12 defined at an upper elliptical shaped portion 14 between a left section 16 and a right section 18. Both the left and right sections have a curved convex edge 20, 22, respectively, that converge towards a bottom tip 24. An outwardly folded or bent segment 25 is disposed along a portion of the edge 20. A similar bent segment 23 is disposed along the edge 22 at the upper portion 14 thereof. The drip catcher 10 is insertable into an opening 26 at a rim 27 of a container 28 by one hand. The left and right sections are symmetrical and the placing of the drip catcher in the opening 26 is always the same, so that a printed logo on a front side 30 will always be visible above the container. The sections 16, 18 consist of a quarter of an ellipse which after pouring cuts off the flow so that no liquid is spilled outside the container.

The drip catcher of the present invention makes the insertion pleasant and easy, also for elderly people. No adjustments are necessary as a cut-out stop or bent segment 23 ensures that the drip catcher 10 is correctly inserted and placed within the opening of the container. The shape of a bottom portion 32 of the drip catcher 10 is shaped so as to tightly fit inside the opening of the container.

Figure 4:
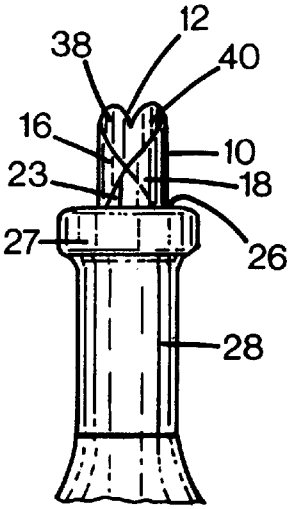
FIG. 4 is a perspective view of the drip catcher fully inserted into the container.
Figure 5:
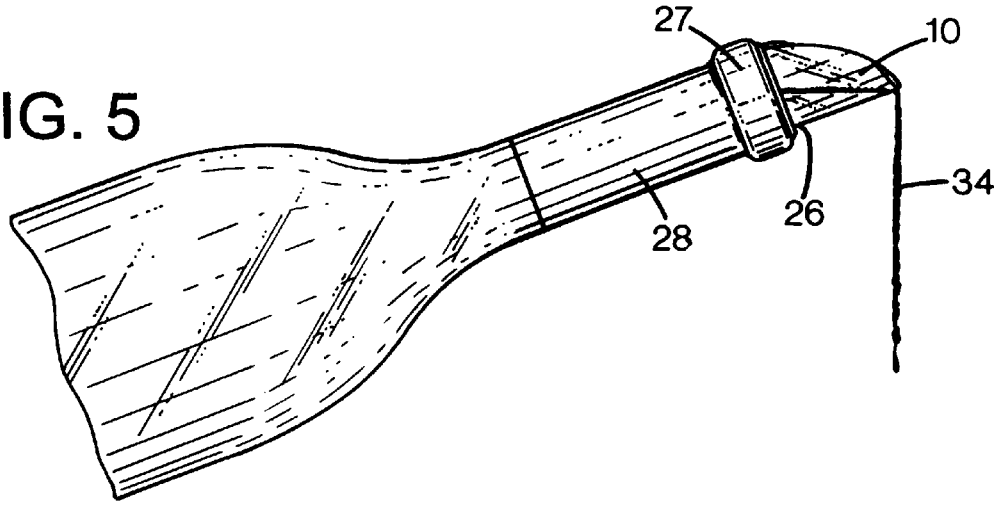
FIG. 5 is a perspective view of the drip catcher with a liquid flowing therethrough.
Figure 6:
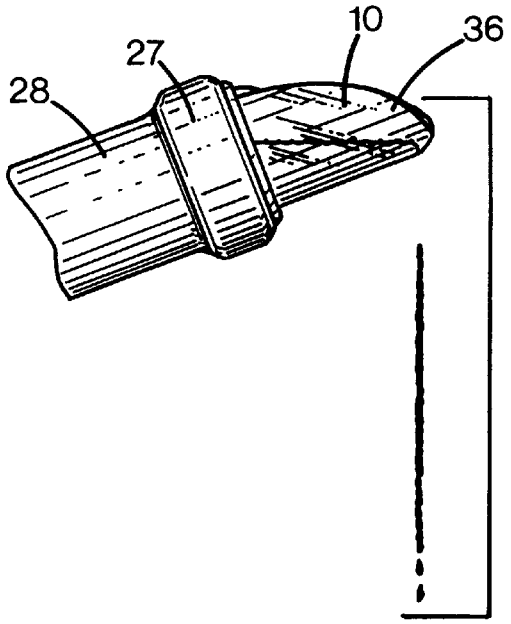
FIG. 6 is a detailed view of the view shown in FIG. 5 showing when the liquid flow is stopped.
Figure 7:
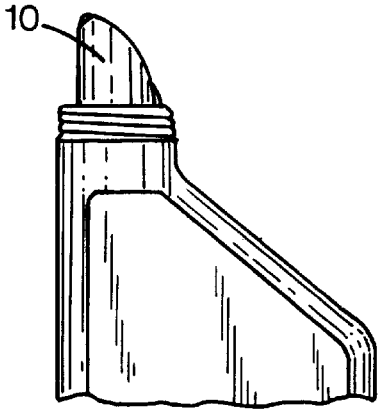
FIG. 7 is a perspective view of the drip catcher disposed in an oil container.
Figure 8:
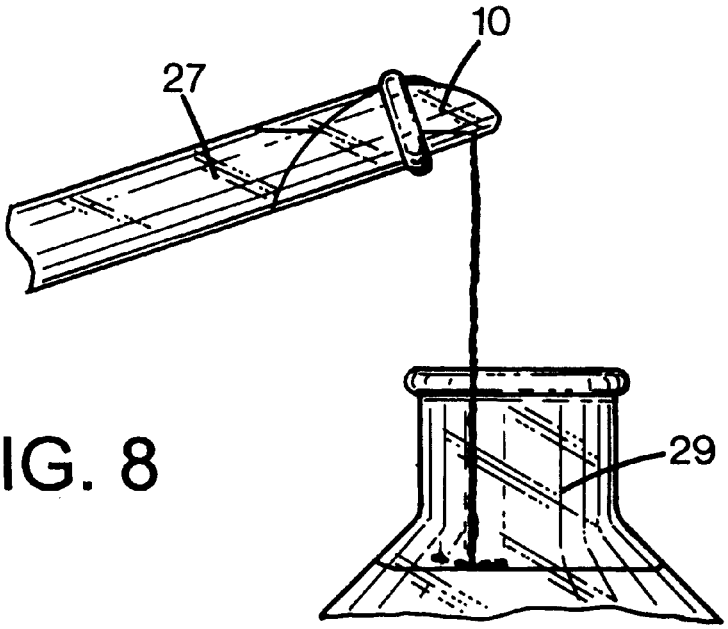
FIG. 8 is a perspective view of the drip catcher inserted into a test tube containing an acid.
Figure 9:
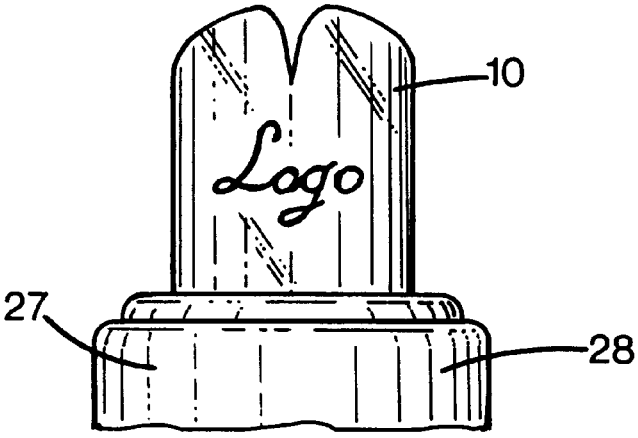
FIG. 9 is a simplified front view of the drip catcher with a logo text.

In operation, the drip catcher may be inserted by holding the drip catcher 10 in a flat position (not rolled up) at the portion 14 over the groove 12 by two fingers (see FIG. 2) and pressed lightly down into the container 28. The bottom 32 bends itself to conform to the round inside of the opening 26 and when the edges 20, 22 meet inside the opening 26, the bent segment 25 enables the side edge 20 to slide over the edge 22 to prevent entanglement and difficulty of insertion. The edges are important because the liquid tends to flow along the edges. The bent segment 25 ensures that the drip catcher may be inserted in the same way every time. This also ensures that any stamped or printed text will be correctly placed and always be visible at the mouth of the container. As best seen in FIG. 4, the segment 23 prevents the drip catcher 10 from being inserted too far into the opening 26 of the container 28.

The drip catcher 10 is not necessarily a disposable article but may be used several times.

After the insertion, the drip catcher 10 provides a cylindrical outlet or opening that closely corresponds to the opening 26 of the container 28. The drip catcher 10 is made of a flexible material that provides a tight fit so that a liquid 34 inside the container 28 can only flow out through an opening 36 formed by the drip catcher 10 when the drip catcher 10 is in the folded position. When the liquid 34 flows through the drip catcher 10, the liquid will be in the form of a regular shaped stream that accurately can be poured without splashing. After the pouring is complete, an elliptically shaped edges 38, 40 (see FIG. 4) disposed on each side of the groove 12 stops the flow in a way to avoid spilling and dripping.

The liquid 34 may have different specific gravity and consistency. It is therefore not enough to make a V-shaped or U-shaped cut-out at the top of a foil to cut off the liquid flow. The present invention does not embody a conventional cut-out but mathematically calculated cut-off edges 38, 40 that function in the following way. A liquid to be cut off after the pouring is completed has a surface tension that varies logarithmetically in proportion to the amount of liquid present in the cut off area. In conventional V or U shaped designs the cutting off of the liquid flow occurs in several steps that starts a small wave which causes spilling. In the present invention, the liquid flow is sharply cut off in just the right moment without causing any wave effect. This sharp cut off provides a very stable and precise cut off point regardless of the velocity of the liquid flow as the container is turned.

When the drip catcher 10 is removed from the container 28, the heart shape causes the sides 16, 18 to be slowly unfolded because of the gently sloping curve of the edges 20, 22 of the heart shaped drip catcher 10 so that the liquid 34 does not splash out as often happens with conventional drip catchers. This is particularly important when acid is poured out of a container 27 into another container 29 (see FIG. 8). The tip 24 serves, besides to start the folding process, to collect the last liquid remaining on the surface 30 and enable it to flow back into the container.

The shape of the drip catcher 10 may be more or less heart shaped but it is important that the shape is such that it provides for an easy insertion and removal without spilling.

I claim:

1. A method of inserting a drip catcher into an opening defined in a rim of a container, comprising:

providing a flexible heart-shaped drip catcher having an upper central groove defined therein, left and right elliptical shaped side edges converging towards a bottom tip, a bent segment disposed on the left side edge adjacent the tip and a folded segment disposed on the right side edge adjacent the central groove, the drip catcher being movable between a flat position and a round folded position;

inserting the tip of the drip catcher in the flat position into the opening of the container having a round inside wall;

engaging a bottom portion of the left and right side edges with the round inside wall;

pressing the drip catcher into the opening of the container;

bending the drip catcher to slide inside the round inside wall;

forming a drip catcher opening inside the opening of the container;

tightly fitting the drip catcher inside the opening of the container;

sliding the bent segment over the right side edge and moving the drip catcher into the round folded position; and pressing the drip catcher into the opening until the folded segment engages the container and a portion of the drip catcher extends outwardly from the container.

2. The method according to claim 1 wherein the method further comprises printing text on the drip catcher.

* * * * *